US006931766B2

(12) United States Patent
Greene

(10) Patent No.: US 6,931,766 B2
(45) Date of Patent: Aug. 23, 2005

(54) FOOTWEAR WITH A SEPARABLE FOOT-RECEIVING PORTION AND SOLE STRUCTURE

(75) Inventor: Pamela Susan Greene, Portland, OR (US)

(73) Assignee: Nike, Inc., Beaverton, OR (US)

( * ) Notice: Subject to any disclaimer, the term of this patent is extended or adjusted under 35 U.S.C. 154(b) by 0 days.

(21) Appl. No.: 10/704,542

(22) Filed: Nov. 12, 2003

(65) Prior Publication Data

US 2005/0097781 A1 May 12, 2005

(51) Int. Cl.[7] ..... A43B 3/24
(52) U.S. Cl. ..... 36/101; 36/15; 36/100
(58) Field of Search ..... 36/101, 15, 100

(56) References Cited

U.S. PATENT DOCUMENTS

| | | | | |
|---|---|---|---|---|
| 1,219,507 A | | 3/1917 | Teare | |
| 2,183,277 A | | 12/1939 | Heilhecker | |
| 2,200,080 A | | 5/1940 | Fein | |
| 2,220,534 A | | 11/1940 | McLean | |
| 2,552,943 A | | 5/1951 | Danielius | |
| 2,588,061 A | | 3/1952 | Vesely | |
| 2,640,283 A | | 6/1953 | McCord | |
| 2,873,540 A | | 2/1959 | Murphy | |
| 3,012,340 A | | 12/1961 | Reinhart | |
| 3,154,866 A | * | 11/1964 | Laufbahn | 36/101 |
| 3,373,510 A | | 3/1968 | Memole et al. | |
| 3,538,628 A | | 11/1970 | Einstein, Jr. | |
| 3,818,617 A | | 6/1974 | Dassler et al. | |
| 3,846,919 A | | 11/1974 | Milotic | |
| 3,878,626 A | | 4/1975 | Isman | |
| 3,902,259 A | | 9/1975 | Cracco | |
| 3,906,646 A | | 9/1975 | Milotic | |
| 3,978,596 A | | 9/1976 | Brown et al. | |
| 3,982,336 A | | 9/1976 | Herro | |
| 4,103,440 A | | 8/1978 | Lawrence | |
| 4,107,857 A | | 8/1978 | Devlin | |
| 4,132,016 A | | 1/1979 | Vaccari | |
| 4,172,330 A | | 10/1979 | Kao | |
| 4,193,214 A | | 3/1980 | Wang | |
| 4,262,434 A | | 4/1981 | Michelotti | |
| 4,267,650 A | | 5/1981 | Bauer | |
| 4,279,083 A | | 7/1981 | Dilg | |
| 4,300,294 A | | 11/1981 | Riecken | |
| 4,317,294 A | | 3/1982 | Goodyear | |
| 4,351,120 A | | 9/1982 | Dalebout | |
| 4,377,042 A | | 3/1983 | Bauer | |
| 4,420,894 A | | 12/1983 | Glassman | |
| 4,439,935 A | * | 4/1984 | Kelly | 36/101 |
| 4,461,102 A | | 7/1984 | DeVincentis | |

(Continued)

FOREIGN PATENT DOCUMENTS

| | | |
|---|---|---|
| FR | 2246163 | 9/1973 |

*Primary Examiner*—Ted Kavanaugh
(74) *Attorney, Agent, or Firm*—Banner & Witcoff, Ltd.

(57) ABSTRACT

The invention is an article of footwear having a foot-receiving portion and a sole portion that are separable. The foot-receiving portion includes a covering portion that is attached to a periphery of a supporting portion to form a volume for receiving a foot. The foot-receiving portion also includes at least one attachment element that engages a corresponding attachment element located on a side of the sole portion, thereby releasably-attaching the foot-receiving portion and the sole portion.

26 Claims, 4 Drawing Sheets

U.S. PATENT DOCUMENTS

| | | | | |
|---|---|---|---|---|
| 4,535,554 | A | 8/1985 | De Obaldia B. | |
| 4,538,368 | A | 9/1985 | Mugford | |
| 4,606,139 | A | 8/1986 | Silver | |
| 4,745,693 | A | 5/1988 | Brown | |
| 4,753,022 | A | 6/1988 | Gasbarro | |
| 4,766,681 | A | 8/1988 | O'Rourke et al. | |
| 4,807,372 | A | 2/1989 | McCall | |
| 4,825,563 | A | 5/1989 | Strongwater | |
| 4,850,122 | A | 7/1989 | Schwab, Jr. | |
| 4,887,369 | A | 12/1989 | Bailey et al. | |
| 4,974,344 | A | 12/1990 | Ching | |
| 5,042,175 | A | 8/1991 | Ronen et al. | |
| 5,083,385 | A | 1/1992 | Halford | |
| 5,317,822 | A | 6/1994 | Johnson | |
| 5,339,544 | A | 8/1994 | Caberlotto | |
| 5,381,610 | A | 1/1995 | Hanson | |
| 5,410,821 | A | 5/1995 | Hilgendorf | |
| 5,533,280 | A | 7/1996 | Halliday | |
| 5,542,198 | A | 8/1996 | Famolare | |
| 5,615,497 | A | 4/1997 | Meschan | |
| 5,628,129 | A | 5/1997 | Kilgore et al. | |
| 5,644,857 | A | 7/1997 | Ouellette et al. | |
| 5,657,558 | A | 8/1997 | Pohu | |
| 5,661,915 | A | 9/1997 | Smith | |
| 5,799,417 | A | 9/1998 | Burke et al. | |
| 5,802,738 | A | 9/1998 | Ferniani | |
| 5,822,888 | A | 10/1998 | Terry | |
| 5,826,352 | A | 10/1998 | Meschan et al. | |
| 5,852,885 | A | 12/1998 | Ferniani | |
| 5,896,608 | A | 4/1999 | Whatley | |
| 5,991,950 | A | 11/1999 | Schenkel | |
| 6,023,857 | A | 2/2000 | Vizy et al. | |
| 6,023,859 | A | 2/2000 | Burke et al. | |
| 6,035,554 | A | 3/2000 | Duncan | |
| 6,311,413 | B1 * | 11/2001 | Chern et al. | 36/15 |
| 6,345,454 | B1 * | 2/2002 | Cotton | 36/101 |
| 6,640,464 | B2 | 11/2003 | Hsin et al. | |
| 2003/0177664 | A1 * | 9/2003 | Monassebian | 36/100 |

* cited by examiner

FIG. 4A
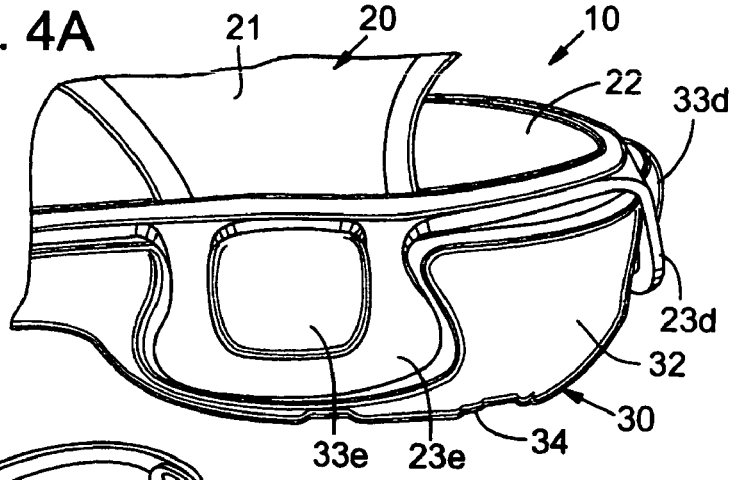
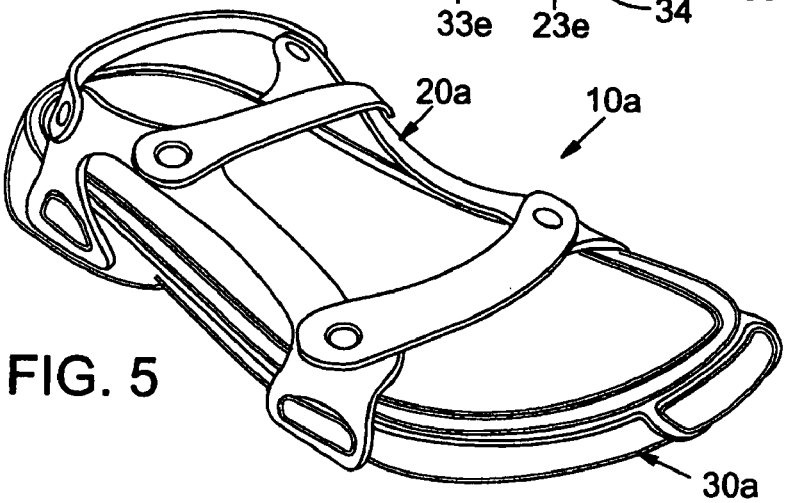
FIG. 5
FIG. 6
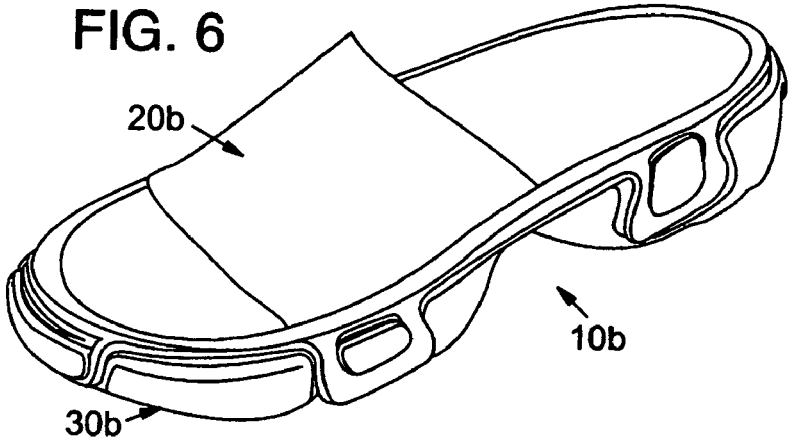

FOOTWEAR WITH A SEPARABLE FOOT-RECEIVING PORTION AND SOLE STRUCTURE

BACKGROUND OF THE INVENTION

1. Field of the Invention

The present invention relates to footwear. The invention concerns, more particularly, an article of footwear having a sole portion that is removable or otherwise separable from a foot-receiving portion.

2. Description of Background Art

The various styles of conventional footwear include athletic footwear, sandals, dress shoes, and boots, for example, and are generally formed of two primary elements, an upper and a sole structure. The specific configuration of the upper and sole structure varies significantly depending upon the style of footwear and the intended use for the footwear. With regard to athletic footwear, for example, the upper may cover the entire foot and is generally formed of lightweight components. The sole structure is formed of multiple layers, including a midsole and an outsole. The midsole attenuates ground reaction forces and absorbs energy upon impact with the ground. The outsole provides a durable, wear-resistant surface and may include texturing to enhance traction. In addition, the sole structure of athletic footwear may include an insole that is positioned within the upper and adjacent to the sole of the foot in order to enhance the comfort of the footwear. The insole is often secured within the upper with an adhesive to prevent the insole from moving relative to the footwear.

Although conventional articles of footwear vary greatly with respect to the configuration of the upper and the sole structure, a common feature of most conventional articles of footwear is that the upper and sole structure are permanently attached to each other.

Although this configuration is well-established in the footwear industry and accepted by consumers, this configuration leads to footwear that may not have optimum durability. When one of the upper or sole structure becomes worn or damaged, the entire article of footwear becomes unusable.

Footwear having a permanently attached upper and sole structure may also have issues with respect to cleansing. The upper and insole, for example, may be formed of cloth or other porous materials and the sole structure may incorporate a lightweight foam material such as polyurethane or ethylvinylacetate. Cleansing conventional articles of footwear may prove difficult due to inaccessibility of the insole and the differing cleansing requirements of the cloth and foam components.

Customizing footwear may be important to consumers from a structural and aesthetic perspective. With respect to conventional footwear, the consumer has few options regarding the manner in which the footwear is fitted because manufacturers generally provide a specific combination of upper and sole structure having specific sizes. The consumer also has few options regarding the material forming the insole or the footbed contour. In addition, the consumer must accept the color combinations and styling provided by the manufacturer.

In an attempt to provide consumers with footwear that overcome one or more of these issues, a plurality of footwear designs wherein the upper is separable from the sole structure have been advanced. U.S. Pat. No. 5,083,385 to Halford discloses an article of footwear with an interchangeable upper. The sole structure has an outsole with vertical walls that extend upward from the outsole. The upper, which is permanently attached to an insole, is placed within the indentation formed by the outsole and walls to secure the upper to the sole structure. U.S. Pat. Nos. 5,852,885 and 5,802,738 to Ferniani disclose a sandal having a separable upper and sole structure, and the upper includes tabs that may be coupled with the sole to attach the upper to the sole structure.

SUMMARY OF THE INVENTION

The invention is an article of footwear having a separable configuration. The primary components of the footwear are a foot-receiving portion and a sole portion. The foot-receiving portion includes a covering element, a supporting element, and a first attachment element. The covering element is configured to extend over at least a portion of an instep of a foot and the supporting element is configured to extend under the foot. The covering element is attached to a periphery of the supporting element to form a volume for receiving the foot, which is located between the covering element and the supporting element. The sole portion includes an upper surface for contacting the supporting element, a lower surface located opposite the upper surface for contacting the ground, and a side surface that extends between the upper surface and the lower surface. The side surface is located on an exterior of the footwear and includes a second attachment element for removably-engaging the first attachment element, thereby separably-attaching the foot-receiving portion and the sole portion.

The foot-receiving portion is structured to securely receive the foot. The covering element may be attached to a medial and a lateral side of the supporting element, for example. This configuration prevents the foot from sliding to the medial or lateral sides, thereby ensuring that the foot remains centered above the sole portion.

The separable configuration of the foot-receiving portion and the sole portion provides footwear with certain benefits. If, for example, one of the foot-receiving portion or the sole portion becomes damaged or worn, that portion may be discarded or recycled and the damaged or worn portion may then be replaced by a new portion. The separable configuration also permits the wearer to independently cleanse the foot-receiving portion and the sole portion. In addition, the various portions of the footwear may be readily modified in an aesthetic or structural manner by replacing one of the elements with an alternate element to provide enhanced fit, different color combinations, or different styling.

The advantages and features of novelty characterizing the present invention are pointed out with particularity in the appended claims. To gain an improved understanding of the advantages and features of novelty, however, reference may be made to the following descriptive matter and accompanying drawings that describe and illustrate various embodiments and concepts related to the invention.

DESCRIPTION OF THE DRAWINGS

The foregoing Summary of the Invention, as well as the following Detailed Description of the Invention, will be better understood when read in conjunction with the accompanying drawings.

FIG. 4A is a partial perspective view depicting an attachment system for the foot-receiving portion and the sole portion.

FIG. 5 is a perspective view of the footwear with a first alternate foot-receiving portion.

FIG. 6 is a perspective view of the footwear with a second alternate foot-receiving portion.

DETAILED DESCRIPTION OF THE INVENTION

Figure 1A:
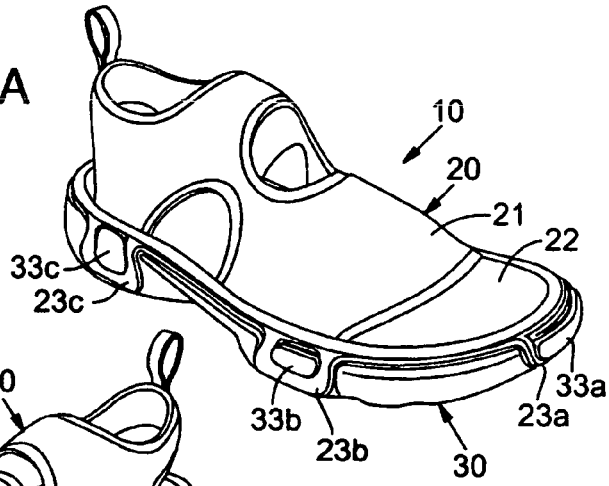
FIG. 1A is a first perspective view of an article of footwear in accordance with the present invention.
Figure 1B:
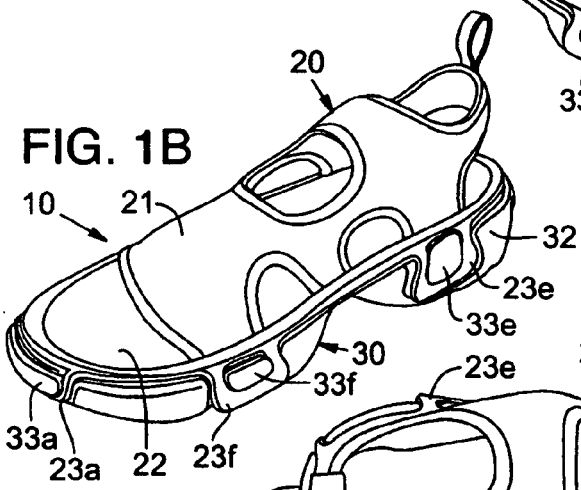
FIG. 1B is a second perspective view of the footwear.
Figure 1C:
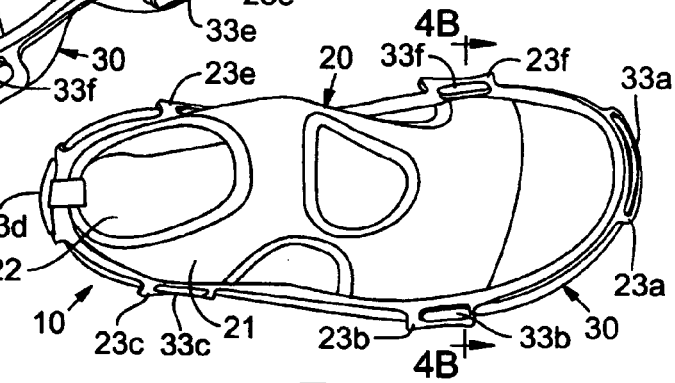
FIG. 1C is a top plan view of the footwear.

The figures and following discussion disclose an article of footwear 10 in accordance with the present invention. Footwear 10 is depicted in FIGS. 1A–1C and includes two primary elements: a foot-receiving portion 20 and a sole portion 30. The upper and sole structure of most conventional articles of footwear are permanently attached to each other and, therefore, may not be separated. Unlike conventional articles of footwear, however, foot-receiving portion 20 and sole portion 30 are discrete, readily separable components. That is, foot-receiving portion 20 may be detached or separated from sole portion 30.

Footwear 10 is depicted in the figures as having the configuration of a sandal. The concepts relating to footwear 10, which are presented in the following discussion, may be applied to a wide range of other footwear styles that include athletic footwear, dress shoes, and boots, for example. One skilled in the relevant art will recognize, therefore, that the concepts disclosed in the following discussion with respect to footwear 10 are not intended to be limited solely to footwear having the general configuration of a sandal, and may be applied to a wide range of other footwear styles.

The separable configuration of foot-receiving portion 20 and sole portion 30 provides footwear 10 with benefits over conventional footwear. If one of foot-receiving portion 20 or sole portion 30 becomes damaged or worn, the portion may be discarded or recycled. The damaged or worn portion may then be replaced by a new portion. In this manner a worn or damaged portion does not render all of footwear 10 unusable. The separable configuration also permits the consumer to properly cleanse both foot-receiving portion 20 and sole portion 30. In addition, the separable configuration provides consumers with the ability to customize footwear 10 with regard to fit or aesthetics. These benefits of footwear 10 will be discussed in greater detail following a complete discussion of the various features of foot-receiving portion 20 and sole portion 30.

Figure 2A:
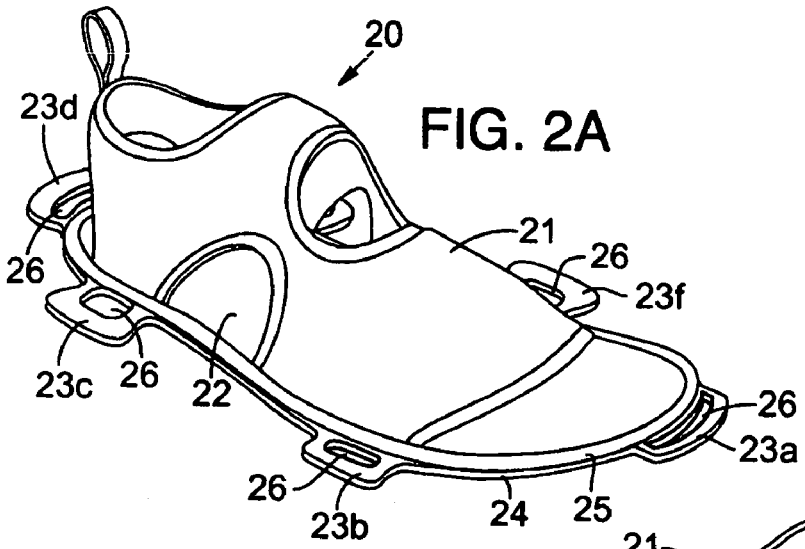
FIG. 2A is a first perspective view of a foot-receiving portion of the footwear.
Figure 2B:
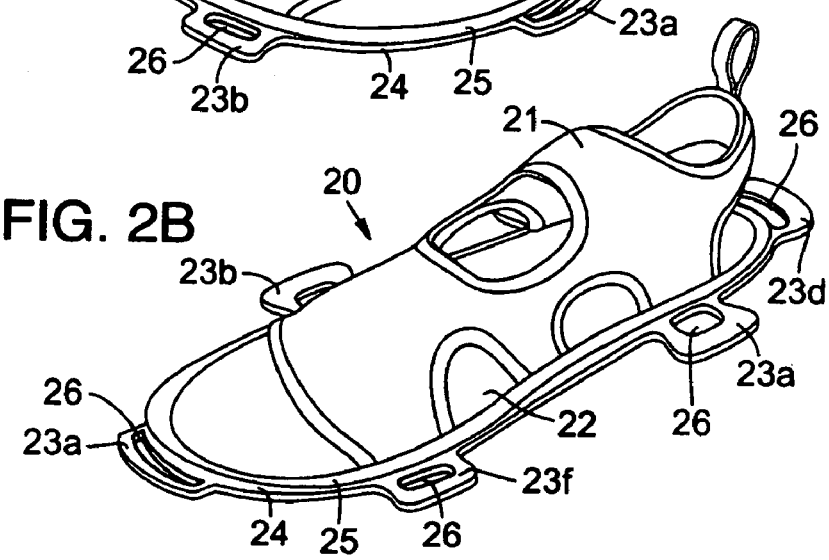
FIG. 2B is a second perspective view of the foot-receiving portion.
Figure 2C:
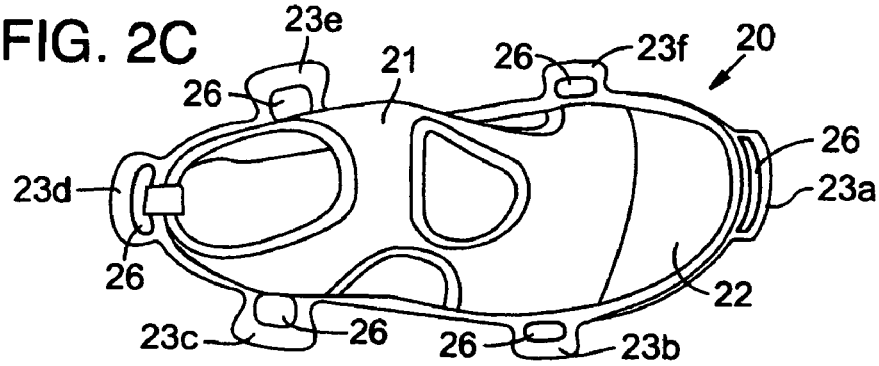
FIG. 2C is a top plan view of the foot-receiving portion.

The primary elements of foot-receiving portion 20, as depicted in FIGS. 2A–2C, are a covering element 21, a supporting element 22, and attachment elements 23*a*–23*f*. In general, the purpose of foot-receiving portion 20 is to comfortably and securely receive a foot. As depicted in the figures, covering element 21 extends over the instep and around the ankle so as to leave the toes, heel, and a portion of the instep exposed. As will be described in greater detail below, covering element 21 may have a variety of footwear styles, including sandal-type configurations. In addition, covering element 21 may be manufactured in the configuration of a shoe to cover the entire foot. If, however, footwear 10 is manufactured in the style of a boot, covering element 21 may be extended upwards to cover the ankle and a portion of the leg. One skilled in the relevant art will appreciate, therefore, that the specific configuration of covering element 21 may vary greatly within the scope of the present invention.

The materials selected for covering element 21 may also vary considerably to include a variety of leather, rubber, textile, or polymer materials, whether elastic or inelastic, for example. Furthermore, covering element 21 may have laces or other mechanisms for tightly-securing footwear 10 to the foot. As noted above, the general purpose of foot-receiving portion 20 is to comfortably and securely receive a foot. The specific configuration, materials, and tightening mechanism utilized for covering element 21 may be selected by one skilled in the relevant art to provide both comfort and a secure fit.

Figure 4B:
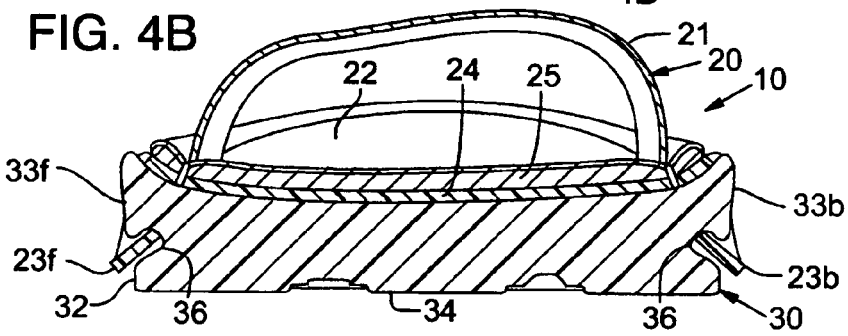
FIG. 4B is a cross sectional view of the footwear, as defined by section line 4B—4B in FIG. 1C.

Supporting element 22 extends under the sole of the foot to provide a surface that supports the foot. Covering element 21 is attached adjacent the periphery of supporting element 22 to form a volume between covering element 21 and supporting element 22 in which the foot is located. Supporting element 22 includes two primary layers, a substrate layer 24 that is positioned adjacent to sole portion 30 and a foot-engaging layer 25 that is positioned between substrate layer 24 and the foot, as depicted in FIG. 4B. Substrate layer 24 provides a durable, resilient surface that contacts sole portion 30 and may be formed from a variety of materials that include leather, rubber, textile, or polymer materials, for example. Accordingly, substrate layer 24 may be formed of the same materials that are suitable for covering element 21. As with a conventional insole, foot-engaging layer 25 may be formed from one or more materials that provide a comfortable surface for engaging the foot. Accordingly, foot-engaging layer 25 may be primarily formed of a foam material, such as ethylvinylacetate or polyurethane foam, and may have a durable material that covers the top surface of the foam, such as a plush or leather material, for example. In some embodiments of the invention, however, foot-engaging layer 25 may be absent such that the foot directly contacts substrate layer 24.

The attachment of covering element 21 to the periphery of supporting element 22 provides a benefit with respect to the stability of the foot. If, for example, covering element were attached to sole portion 30, rather than to supporting element 22, the foot could slip off the edge of sole portion 30. In footwear 10, however, the secure attachment between covering element 21 and supporting element 22 restrains lateral and medial movement of the foot within footwear 10. Similar considerations may also apply with respect to forward and rearward movement of the foot, depending upon the specific construction of foot-receiving portion 20.

In addition to covering element 21 and supporting element 22, foot-receiving portion 20 includes attachment elements 23*a*–23*f* that engage sole portion 30 to secure foot-receiving portion 20 to sole portion 30. The specific number of attachment elements 23*a*–23*f* may vary depending upon the style of footwear, type of attachment mechanism utilized, required attachment strength, and intended use for the footwear. Referring to footwear 10 specifically, six attachment elements 23*a*–23*f* are distributed around the periphery of foot-receiving portion 20 and extend outward from the periphery of foot-receiving portion 20. Attachment element 23*a* is located on a front portion of foot-receiving portion 20, attachment elements 23*b* and 23*c* are located on a lateral side, attachment element 23*d* is located on a rearward portion of foot-receiving portion 20, and attachment elements 23*e* and 23*f* are located on a medial side of foot-receiving portion 20. As depicted in the figures, attachment elements 23*a*–23*f* are co-planar with the remainder of supporting element 22 when not joined with sole portion 30. Alternately, attachment elements 23*a*–23*f* may extend outward to as to be perpendicular to the remainder of supporting element 22.

Each of attachment elements 23*a*–23*f* engage a corresponding attachment element 33*a*–33*f* of sole portion 30 to secure foot-receiving portion 20 to sole portion 30. The specific structure of attachment elements 23*a*–23*f* and 33*a*–33*f* may vary considerably within the scope of the present invention to include snap or button-type fasteners, hook and pile fastening systems, magnetic fasteners, or other mechanical fasteners, for example. As depicted in the figures, the attachment elements 23*a*–23*f* and 33*a*–33*f* most resemble a button-type fastener wherein each of attachment elements 33*a*–33*f* protrude through one of an apertures 26 formed in attachment elements 23*a*–23*f*. Alternately, attachment elements 23*a*–23*f* may protrude through an apertures formed in attachment elements 33*a*–33*f*. The manner in which attachment elements 23*a*–23*f* and attachment elements 33*a*–33*f* operate to connect and separate foot-receiving portion 20 and sole portion 30 will be discussed in greater detail following a discussion of the features of sole portion 30.

Attachment elements 23*a*–23*f* may be formed and connected to foot-receiving portion 20 through a variety of methods. As depicted in the figures, attachment elements 23*a*–23*f* are formed integral with substrate layer 24. A benefit of this configuration is that substrate layer 24 and attachment elements 23*a*–23*f* may be formed from a single element of durable and resilient material. This permits both elements to be formed in individual manufacturing step, thereby eliminating the need to separately form and connect attachment elements 23 to foot-receiving portion 20. Despite this benefit, attachment elements 23*a*–23*f* may be formed separately and attached to any of the plurality of elements that form foot-receiving portion 20. Furthermore, substrate layer 24 may be formed through a dual-injection process, wherein attachment elements 23*a*–23*f* are formed from an elastic material and the remainder of substrate layer 24 is formed of a material that comfortably supports the foot.

Figures 3A, 3B, 3C:
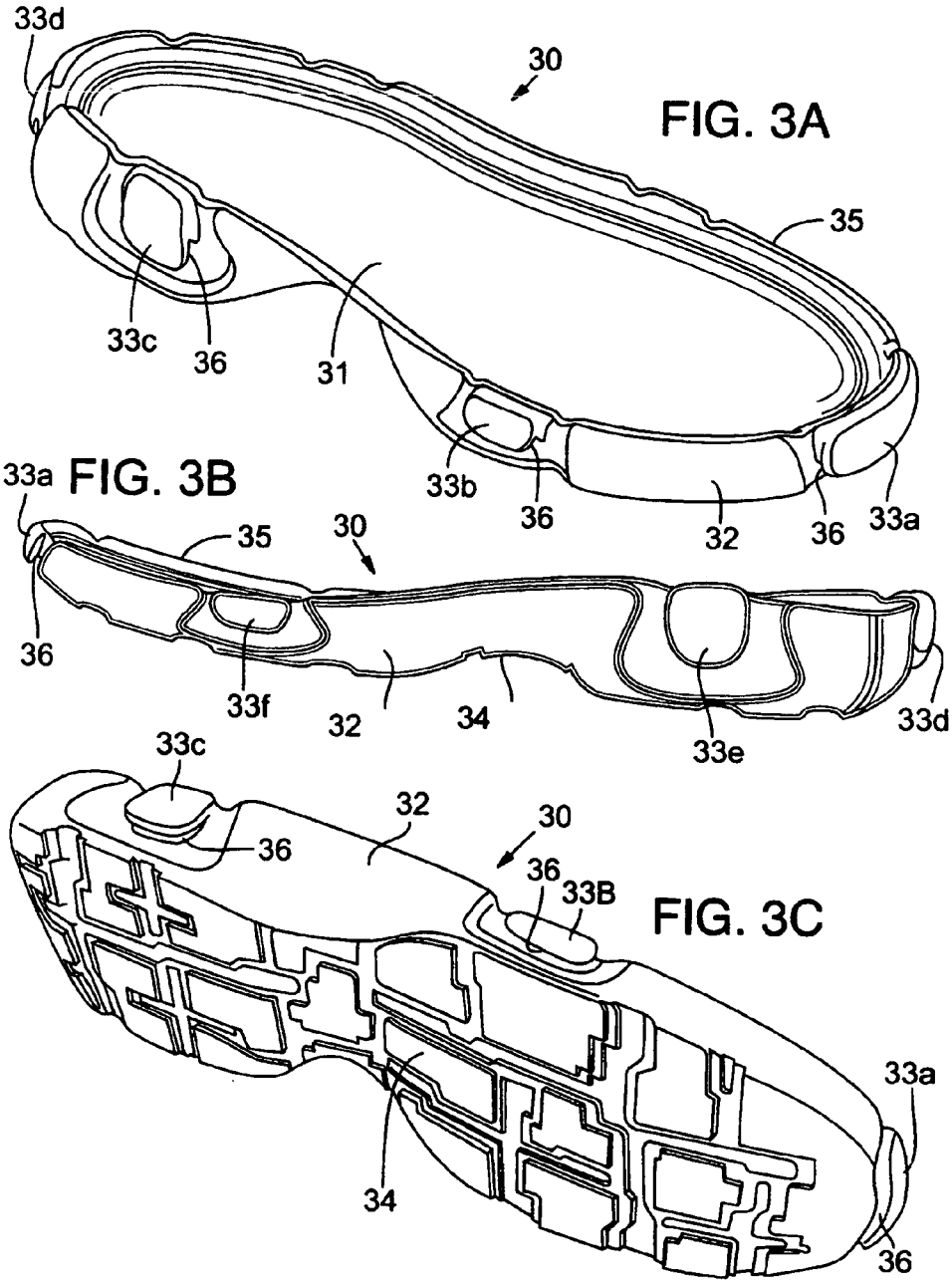
FIG. 3A is a first perspective view of a sole portion of the footwear.
FIG. 3B is a side elevational view of the sole portion.
FIG. 3C is a second perspective view of the sole portion.

Sole portion 30, depicted individually in FIGS. 3A–3C, generally serves the function of a sole structure for an article of footwear. Accordingly, sole portion 30 provides a structure that attenuates shock and absorbs energy as footwear 10 impacts the ground. In effect, therefore, sole portion 30 provides a comfortable element that cushions the foot during activities such as walking or running. Sole portion 30 may also provide a wear surface that contacts the ground and provides traction.

The primary surfaces of sole portion 30 are an upper surface 31, a side surface 32, on which attachment elements 33*a*–33*f* are located, and a lower surface 34. Upper surface 31 is configured to engage supporting element 22 and may include a raised periphery 35 that positively seats supporting element 22. Periphery 35 may have a plurality of indentations that receive portions of attachment elements 23 when attachment elements 23 are engaged with attachment elements 33*a*–33*f*. Upper surface 31 may be contoured to provide a comfortable shape that supports the natural structure of the foot. Accordingly, upper surface 31 may have a heel region that is raised in relation to a forefoot region, and upper surface 31 may include a raised arch, for example. Side surface 32 extends downward from upper surface 31 and includes the plurality of attachment elements 33*a*–33*f*. Lower surface 34 is located opposite upper surface 31 and provides a durable, wear-resistant area for engaging the ground.

Depending upon the wear-resistance of the material that forms sole portion 30, a conventional outsole may or may not be utilized. If an outsole is utilized, lower surface 34 may be bonded to a thin layer of material, such as carbon black rubber compound, that is textured to enhance traction. If an outsole is not utilized, however, lower surface 31 is formed of the material that forms the remainder of sole portion 30 and may include texturing. A benefit to utilizing a material that does not require an outsole is the single manufacturing step that may be employed in forming sole portion 30. Suitable materials for sole portion 30 include, therefore, ethylvinylacetate, an ethylvinylacetate-rubber blend, or polyurethane foam, for example.

The manner in which attachment elements 23*a*–23*f* and attachment elements 33*a*–33*f* operate, as depicted in FIGS. 4A and 4B, will now be discussed. Attachment elements 23*a*–23*f* and 33*a*–33*f* may be any type of mechanical fastener, including snap or button-type fasteners, hook and pile fasteners, or magnetic fasteners, for example. As depicted in the figures, however, attachment elements 23*a*–23*f* and 33*a*–33*f* most resemble a button-type fastener wherein each attachment elements 33*a*–33*f* protrude through a corresponding aperture 26 formed in attachment elements 23*a*–23*f*. Attachment elements 23*a*–23*f* each form an aperture 26 that stretches over and is secured within indentations 36 formed in a lower portion of attachment elements 33.

To engage attachment element 23*b* with attachment element 33*b*, for example, an individual may grasp attachment element 23*b* and place a downward force upon the attachment element 23*b*, thereby enlarging aperture 26. Attachment element 23*b* may then be stretched over attachment element 33*b* such that a lower edge of attachment element 23*b* is located within indentation 36 in attachment element 33*b*. Releasing the downward force causes aperture 26 to decrease in size, thereby securing attachment element 23*b* around attachment element 33*b* and within indentation 36. Indentation 36, therefore, receives attachment element 23*b* and effectively prevents unintentional disengagement. To disengage attachment elements 23*b* and 33*b*, the individual may grasp and place another downward force upon attachment element 23*b*, thereby enlarging aperture 26 and removing attachment element 23*b* from indentation 36. This process may be repeated for each attachment element 23*a*–23*f* and 33*a*–33*f* in order to selectively attach and separate foot-receiving portion 20 and sole portion 30.

Attachment elements 33*a*–33*f* may be formed from the same material that forms sole portion 30. The material that forms sole portion 30 generally has sufficient compliance to bend as the foot flexes and provide both shock attenuation and energy absorption. When walking or running, footwear 10 will flex and generate forces that attempt to separate foot-receiving portion 20 and sole portion 30. Depending upon the material that forms sole portion 30, the stresses in attachment elements 23*a*–23*f* and 33*a*–33*f* may be sufficient to deform one or more of attachment elements 33*a*–33*f* in a manner that unintentionally disengages one or more of attachment elements 23*a*–23*f* from attachment elements 33*a*–33*f*. In order to prevent or limit the occurrence of unintentional disengagement of attachment elements 23*a*–23*f* and 33*a*–33*f*, attachment elements 33*a*–33*f* may be formed separately of a more rigid material, such as an injection-molded polymer. The separate attachment elements 33 may then be secured to side surface 32 with an adhesive, for example.

The structure of footwear 10 provides a plurality of advantages over conventional footwear that have a non-separable configuration. One of foot-receiving portion 20 and sole portion 30 may become damaged through excessive wear or abuse, for example. In conventional footwear, the entire article of footwear would be discarded due to the damage to an individual portion of the footwear. With footwear 10, however, the damaged portion may be separated from the non-damaged portion and replaced. This has the potential to provide consumers with an article of footwear that is more economical than other footwear.

Footwear 10 may also be cleansed more effectively than conventional footwear. In both footwear 10 and conventional footwear, sweat, dirt, debris, or other contaminants may affect the aesthetics and odor of the footwear. In particular, the contaminants may infiltrate the area of the footwear immediately underlying the foot. Conventional footwear often incorporates an insole that is adhesively secured to the interior of the footwear. Cleansing this area may, therefore, prove difficult. With regard to footwear 10, however, foot-receiving portion 20 and sole portion 30 may be separated and the area may be effectively cleansed. In addition, the sole of an article of footwear, which may be formed from foam and rubber materials, may have different cleansing requirements than the upper, which is often formed from textiles. With footwear 10, however, the different materials that form foot-receiving portion 20 and sole portion 30 may each be cleansed separately in a manner that appropriately considers their unique materials or cleansing requirements.

Footwear manufacturers attempt to provide consumers with footwear that is aesthetically pleasing to a large percentage of the population. In an ideal marketplace, manufacturers would provide styles of footwear in many different color combinations. To the disadvantage of retailers, a wide variety of color combinations increases the inventory that retailers must hold in order to provide footwear in a wide variety of sizes and color combinations. For this reason, manufacturers generally supply footwear in limited color combinations. Footwear 10, however, provides consumers with the ability to purchase foot-receiving portion 20 and sole portion 30 separately in order to have an article of footwear that has a unique, personalized color scheme. Similar considerations may also be utilized with regard to designs that are placed upon the footwear and the materials that form the various components.

In addition to modifications for aesthetic purposes, footwear 10 may also be modified with respect to the fit of footwear 10. Whereas one individual may require footwear with a low arch, for example, another individual may require a high arch. In order to modify footwear 10 to have a specific arch configuration, a consumer may replace foot-receiving portion 20 with an alternate foot-receiving portion 20 that has the desired arch configuration. In addition to the arch configuration, footwear 10 may be modified with respect to footwear size or length, for example, by utilizing different combinations of foot-receiving portion 20 and sole portion 30.

The system disclosed with respect to footwear 10 also provides the consumer with the ability to utilize a single sole portion 30 with a plurality of foot-receiving portions 20 to modify the type of footwear. Footwear 10 is depicted as a sandal that covers approximately one-half of the instep portion of the foot and extends around the ankle. Footwear 10*a*, depicted in FIG. 5, incorporates a sole portion 30*a* that is substantially identical to the sole portion 30 utilized in footwear 10, but foot-receiving portion 20*a* provides a different style of sandal. Similarly, footwear 10*b*, which is depicted in FIG. 6, has a foot-receiving portion 20*b* with a configuration that differs from foot-receiving portion 20 and 20*a*. Another foot-receiving portion 20 may also be utilized that covers a substantial portion of the foot and, therefore, has the configuration of an upper for a running shoe, for example. Accordingly, footwear 10 may be readily converted from a first type of footwear to a second type of footwear by merely changing foot-receiving portion 20. In addition, sole portion 30 may be changed in order to provide a different sole configuration. For example, a first sole portion 30 may be suitable for walking on highly compliant surfaces, such as sand, whereas a second sole portion 30 may provide additional shock attenuation and energy absorption properties that are suitable for walking on less compliant surfaces, such as concrete.

Differences in the configuration of foot-receiving portion 20 are not limited to sandals. Foot-receiving portion 20 may also have the configuration of a shoe or a boot, for example. In addition, sole portion 30 may be exchanged with a different sole portion 30 to alter the style of footwear 10. Accordingly, foot-receiving portion 20 and sole portion 30 provide a means for modifying many aspects of footwear 10, including aesthetics, fit, and style.

The present invention is disclosed above and in the accompanying drawings with reference to a variety of embodiments. The purpose served by the disclosure, however, is to provide an example of the various features and concepts related to the invention, not to limit the scope of the invention. One skilled in the relevant art will recognize that numerous variations and modifications may be made to the embodiments described above without departing from the scope of the present invention, as defined by the appended claims.

That which is claimed is:

1. An article of footwear comprising:

a foot-receiving portion configured to extend over a foot to contact an instep of the foot, and the foot-receiving portion being configured to extend under the foot to contact a sole of the foot, and the foot-receiving portion including a first attachment element; and a sole portion that is discrete from the foot-receiving portion, the sole portion having an upper surface for contacting the foot-receiving portion, and the sole portion having a side surface located on an exterior of the footwear, the side surface including a second attachment element for releasably-engaging the first attachment element, the first attachment element and the second attachment element separably-attaching the foot-receiving portion and the sole portion, the first attachment element forming an aperture and the second attachment element forming a protrusion, the aperture receiving the protrusion to releasably-engage the first attachment element and the second attachment element.

2. The article of footwear recited in claim 1, wherein the foot-receiving portion includes a covering element for extending over the foot and a supporting element for extending under the foot, the covering element being attached to at least a portion of a periphery of the supporting element.

3. The article of footwear recited in claim 2, wherein the covering element is attached to a medial side and a lateral side of the supporting element.

4. The article of footwear recited in claim 2, wherein the first attachment element is formed integral with the supporting element.

5. The article of footwear recited in claim 2, wherein the first attachment element extends outward from the supporting element.

6. The article of footwear recited in claim 1, wherein the upper surface of the sole portion includes a raised periphery that forms a recess for receiving the foot-receiving portion.

7. The article of footwear recited in claim 1, wherein the protrusion includes an indentation for receiving an edge of the first attachment element and securing the first attachment element to the second attachment element.

8. The article of footwear recited in claim 1, wherein the foot-receiving portion includes a plurality of the first attachment element, and the side surface includes a plurality of the second attachment element, the plurality of the first attachment element being distributed around a perimeter of the foot-receiving portion, and the plurality of the second attachment element being distributed around the side surface, the plurality of the first attachment element and the plurality of the second attachment element being located to engage each other.

9. An article of footwear comprising:

a foot-receiving portion that includes a covering element, a supporting element, and a first attachment element, the covering element being configured to extend over at least a portion of an instep of a foot, and the supporting element being configured to extend under the foot, the covering element being attached to at least a portion of a periphery of the supporting element to form a volume for receiving the foot, the volume being between the covering element and the supporting element; and a sole portion that includes an upper surface for contacting the supporting element, a lower surface located opposite the upper surface for contacting a ground, and a side surface extending between the upper surface and the lower surface, the side surface being located on an exterior of the footwear, and the side surface including a second attachment element for releasably-engaging the first attachment element to separably-attach the foot-receiving portion and the sole portion, and the upper surface of the sole portion includes a raised periphery that forms a recess for receiving the foot-receiving portion.

10. The article of footwear recited in claim 9, wherein the first attachment element forms an aperture and the second attachment element forms a protrusion, the aperture receiving the protrusion to releasably-engage the first attachment element and the second attachment element.

11. The article of footwear recited in claim 10, wherein the protrusion includes an indentation for receiving a portion of the first attachment element and securing the first attachment element to the second attachment element.

12. The article of footwear recited in claim 9, wherein the covering element is attached to a medial and a lateral side of the supporting element.

13. The article of footwear recited in claim 12, wherein the first attachment element extends outward from at least one of the medial and lateral side of the supporting element.

14. The article of footwear recited in claim 13, wherein the first attachment element is formed integral with the supporting element.

15. The article of footwear recited in claim 9, wherein the foot-receiving portion includes a plurality of the first attachment element, and the side surface includes a plurality of the second attachment element, the plurality of the first attachment element being distributed around a perimeter of the foot-receiving portion, and the plurality of the second attachment element being distributed around the side surface, the plurality of the first attachment element and the plurality of the second attachment element being located to engage each other.

16. An article of footwear comprising a foot-receiving portion and a separate sole portion, the foot-receiving portion including:

a covering element configured to extend over at least a portion of an instep of a foot;

a supporting element configured to extend under the foot, the covering element being secured to at least a portion of a medial side and a lateral side of the supporting element; and a plurality of first attachment elements secured to one of the covering element and the supporting element, the first attachment elements being distributed around the foot-receiving portion, and each of the first attachment elements forming an aperture, and said sole portion including:

an upper surface for contacting the supporting element;

a lower surface located opposite the upper surface for contacting a ground;

a side surface extending between the upper surface and the lower surface, the side surface being located on an exterior of the footwear; and a plurality of second attachment elements located on the side surface, each of the second attachment elements forming a protrusion, and each of the apertures being configured to receive one of the protrusions to releasably-engage the first attachment element and the second attachment element, wherein the foot-receiving portion and the sole portion are attached together by engaging the first attachment elements and the second attachment elements, and the foot-receiving portion and the sole portion are separated by releasing the first attachment elements and the second attachment elements.

17. The article of footwear recited in claim 16, wherein the first attachment element is formed integral with the supporting element.

18. The article of footwear recited in claim 16, wherein the upper surface of the sole portion includes a raised periphery that forms a recess for receiving the foot-receiving portion.

19. The article of footwear recited in claim 16, wherein the protrusion includes an indentation for receiving a portion of the first attachment element and securing the first attachment element to the second attachment element.

20. The article of footwear recited in claim 16, wherein the first attachment elements and the second attachment elements are distributed in medial, lateral, front, and back portions of the footwear.

21. An article of footwear for receiving a foot of a wearer, the footwear comprising:

an upper configured to extend under the foot and over at least a portion of an instep of a foot, the upper including a first part of an attachment system; and a sole structure that includes a second part of the attachment system for joining the upper to the sole structure, the second part of the attachment system being positioned on an exterior side surface of the sole structure;

wherein the footwear includes a plurality of the first part and a plurality of the second part, the plurality of the first part and the plurality of the second part being distributed in medial, lateral, front, and back portions of the footwear, and the first part forms an aperture and the second part forms a protrusion, the aperture receiving the protrusion to releasably-engage the first part and the second part.

22. The article of footwear recited in claim 21, wherein the first part of the attachment system extends outward from the second element and is formed integral with the second element.

23. The article of footwear recited in claim 21, wherein an upper surface of the sole structure forms a depression for receiving the second element.

24. An article of footwear for receiving a foot of a wearer, the footwear comprising:

an upper configured to extend under the foot and over at least a portion of an instep of a foot, the upper including a first element that extends over the foot and a second element that extends under the foot, the first element being secured to at least a portion of a medial side and a lateral side of the second element, and the upper including a first part of an attachment system; and a sole structure that includes a second part of the attachment system for joining the upper to the sole structure, the second part of the attachment system being positioned on an exterior side surface of the sole structure;

wherein the footwear includes a plurality of the first part and a plurality of the second part, the plurality of the first part and the plurality of the second part being distributed in medial, lateral, front, and back portions of the footwear.

25. The article of footwear recited in claim 24, wherein the first part of the attachment system extends outward from the second element and is formed integral with the second element.

26. The article of footwear recited in claim 24, wherein an upper surface of the sole structure forms a depression for receiving the second element.

* * * * *